US005190443A

United States Patent [19]

Valdes

[11] Patent Number: 5,190,443

[45] Date of Patent: Mar. 2, 1993

[54] HYDROPNEUMATIC CONSTANT PRESSURE DEVICE

[76] Inventor: Osvaldo Valdes, Las Lavandulas 10168, Las Condes, Santiago, Chile

[21] Appl. No.: 706,599

[22] Filed: May 30, 1991

[30] Foreign Application Priority Data

Jun. 1, 1990 [AR] Argentina ..... 317005

[51] Int. Cl.[5] ..... F04B 49/02; F04B 49/06; F04B 49/08

[52] U.S. Cl. ..... 417/38; 417/43; 417/543

[58] Field of Search ..... 417/38, 43, 540, 543

[56] References Cited

U.S. PATENT DOCUMENTS 3,782,858 1/1974 Deters ..... 417/38

4,329,120 5/1982 Walters ..... 417/38

*Primary Examiner*—Richard A. Bertsch

*Assistant Examiner*—David W. Scheuermann

*Attorney, Agent, or Firm*—Cushman, Darby & Cushman

[57] ABSTRACT

A hydropneumatic arrangement is provided for actuating a pump upon pressure decrease and for deactivating the pump upon flow decrease. The hydropneumatic arrangement includes a bearing cylinder; a flow sensor piston movably disposed within the bearing cylinder; a driving piston connected to the flow piston by a common shaft, the flow sensor piston being moved according to a variation in consumption demand by an interaction of a force of flow exerted against the flow sensor piston and a force of pressure exerted on the driving piston. A pressure switch is provided and is electrically connected to an electric motor that drives the pump. The drive cylinder communicates with the pressure switch, the drive cylinder being opened to system pressure in the driving piston, communicated toward the system pressure due to a sealing arrangement that permits a flow outwardly of, but not inwardly into, the drive cylinder and communicated from the system pressure only when the flow sensor piston is at a point of maximum displacement. A hydropneumatic tank is provided having an air injection pump. The arrangement also includes an actuating piston for driving the injector pump piston.

11 Claims, 4 Drawing Sheets

HYDROPNEUMATIC CONSTANT PRESSURE DEVICE

The field of application of this invention, which will be styled hereinafter "Sensaflow", is the automatic control for the operation and stopping of electrical motor driven pumps that supply pressurized water or another liquid, according to a variable consumption demand.

Sensaflow solves the following technical problems:

1. Eliminates one of the greatest deficiencies of the hydrosphere which are possible air leakages.

2. Expedites the regulation of the pressure switch.

3. Permits the use of pumps within its characteristic limits which are impossible for the other systems.

4. Enables the decrease in pressure of the system when no consumption exists, except that produced by leaks and/or filtrations, which extends the frequency between two startings of the pump; such undesired consumption may even disappear due to the lower pressure exercised thereupon.

5. Due to the greater difference in pressures, the regulation volume increases. This enables the use of a quite reduced hydropneumatic tank, which represents a lower cost and allows the device to be installed in smaller spaces.

6. The smaller hydropneumatic tank may be manufactured with materials with high resistance against the aggressiveness of the environment, which substantially increases its useful life.

The basic elements comprising Sensaflow are the following:

Flow Sensor Device: a set installed in the pump drive to detect the variation in consumption demand.

Drive Device: a set which forces the flow sensor against the pump drive until cut-out pressure is transmitted to the pressure switch.

Pressure Transfer Device: a set that communicates the pressure to the pressure switch only when the rising pressure reaches the one corresponding to Qg, but permanently permits the transmission of pressure from the pressure switch to the system with any decrease in the pressure of the system.

Pressure switch: Pressure-activated electric switch.

Hydropneumatic Tank: watertight tank.

Air-Pump Actuator: a set which uses the force of the liquid when entering and leaving the hydropneumatic tank.

Air-Injection Pump: a set that receives the force of the air-pump actuator to pump outside air to the hydropneumatic tank in every on-off operation cycle of the motorpump and replaces any air that is dissolved.

Transfer Device: a set which permits the entry of water to the hydropneumatic tank without limitation of passage, but which permits the limitation of its outflow pursuant to a determined volume of flow.

The on-off operation of an electrical motor pump to supply the demand for pressurized water or another liquid with variable consumption, demands the use of an automatic control system. Evidently, the cost of maintaining a pump operating permanently to supply a variable demand, which goes from zero to a consumption equal or lower than the pumping volume of flow, is very high due to the excessive cost of energy and wear of the pump during the time when it is underused. Since the appearance of the electrical motorpump, various automatic control systems for its operation and stopping have been developed. The first one was the use of a high accumulation tank. In this case, the pump fills the tank and demand for consumption is supplied therefrom. Pressure is obtained by the height of water over the consumption. The on-off operation of the pump is achieved by a electrical level switch, installed in the tank, which activates the pump when the water reaches a lower level and stops it when it reaches a higher level. Both levels are prefixed and are detected either by floating buoys or by electrodes.

A control system that represents a substantial improvement is the hydropneumatic tank, since it eliminates the use of expensive structures necessary to support the elevated tank. The systems maintains water pressure, not by differences in elevation, but by the force of the compressed air. This system is comprised by the pump, the hydropneumatic tank with an air recovery apparatus and a pressure switch. The latter is an electrical switch activated by the pressure of the system. The system operates as follows: When water consumption exists, the pressure of the system goes down until reaching a point where the pressure switch is connected and activates the pump. The pump supplies the produced demand. If demand is greater than the volume of flow of the pump at cut-out pressure, the pump continues operating. But if the demand is lower, the pressure of the system increases up to the point when the pressure switch is disconnected, stopping the pump. If the consumption is steady, the pressure goes down once again and the pressure switch once again activates the pump, completing the cycle.

This cycle between two starts would be so brief and the frequency so high that the system would be damaged in a short term in the absence of a pressurized volume of water that maintains consumption supplied with a tolerable frequency between starts. The volume of pressurized water, designated as regulation volume, is dimensioned in order that a determined period of time prevails between the starting times of the pump and corresponds to the one accumulated by the hydropneumatic tank due to pressure differential, that is, between cut-in pressure and cut-out pressure. In cut-out pressure, the air of the tank has been compressed and the space has been occupied by water of the regulation volume. To the extent that the volume is being utilized to cover consumption, its pressure decreases until reaching the cut-in pressure. When the pump operates, it covers consumption and the surplus is accumulated in the tank until pressure reaches the cut-out point once again, completing the cycle. Now then, since the water is in contact with air and both are subject to pressure, air would finally be dissolved in the water if the system lacked an air recuperator. This may consist in a motor-compressor or an injector activated by the negative pressure of the pump suction. The connection in the tank for the air recuperator is placed just over the level reached by the water at cut-out pressure: if the water surpasses it, the air recuperator acts.

The hydropneumatic system was surpassed since 1970 by the introduction of the hydrosphere system. This system differs from the hydropneumatic one in that the tank contains a rubber bladder that houses the regulation volume and leakage-proof air between the cylinder and the wall of the tank. Hydrosphere has three important advantages over the hydropneumatic tank: 1) it is smaller, since the air is preinjected at the system cut-in pressure, which eliminates the additional tank volume required to compress air from the atmospheric pressure to such pressure: 2) it requires no air injector and, since the air is separated from the water by the cylinder, the air is not dissolved by exhaustion, and 3) since the water is contained in a rubber bladder, the tank is not corroded or rusted internally. However, that part of the metallic tank where the bladder rests, is cooled by the absorption of heat towards the colder water inside the bladder. The moisture of the external air is condensed on the surface, expediting the rusting of the metal.

The "Sensaflow" appliance, subject matter of the invention, has an advantage over hydrosphere in four decisive aspects:

1. Eliminates possible leaks of leakage-proof air, which is one of the greatest deficiencies of hydrosphere.

2. The regulation of the cut-out pressure is performed automatically, which avoids operating problems due to deficiencies in regulation or deregulation and, furthermore, it permits the use of pumps in pressure limits impossible with hydrosphere.

3. Has a much smaller accumulation tank, which makes it cheaper and permits its installation in smaller spaces.

4. Due to its smaller size, it may be manufactured with materials that have excellent resistance against the aggressiveness of the environment, principally against rusting and corrosion, which substantially increases its useful life.

The Sensaflow appliance, covered by the invention, comprises interdependent functional components. Before describing the operation of the system as a whole, we shall analyze in the first place the operation of each component in particular, referred to the accompanying Figures wherein.

Figure 1A:
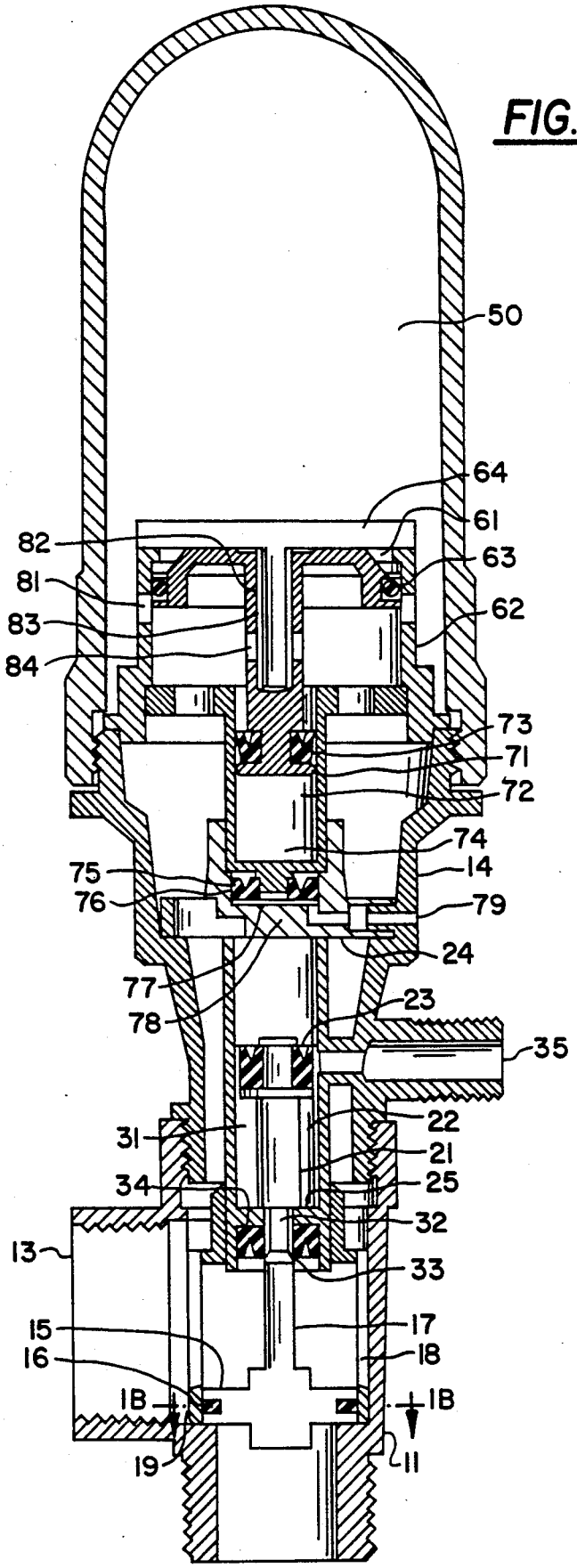
FIG. 1A is a cross-sectional view of the hydropneumatic device provided in accordance with the principles of the present invention.
Figure 1B:
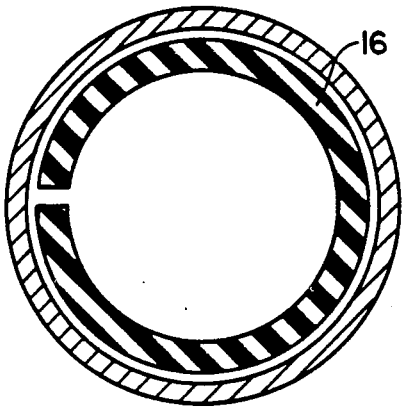
FIG. 1B is a view taken along line 1B—1B of FIG. 1A.

Flow Sensor Device: This component device is located in a "three-outlet connector" (11): a lower outlet connected to the "motorpump drive" (12); a lateral outlet connected to "consumption" (13) and an upper outlet attached to the "external body" (14) of the Sensaflow. The flow sensor element is the "sensor piston" (15) which is a gate that includes in its contour a fitted "split ring" (16). The sensor piston is displaced, along its "sensor shaft" (17) within the "protector cylinder" (18). This is of a basket type with longitudinal supports that permit the passage of the flow, through them and outwards and maintains the sensor piston in its shaft. The sensor piston in its lower point, is inserted in the "bearing cylinder" (19), in such way that the split ring seals the space between the bearing cylinder and the sensor piston, except in the area that produces the breaking of the split ring which is a quite determined opening which is the means of passage of a volume of flow which we shall call "Qg", equivalent to what is consumed by a partially open consumption. Therefore, the section of the opening is critical in order that exactly such volume of flow may pass therethrough. When consumption is higher, the sensor piston is displaced upwards by the force of the flow pressure demanded in its area, and this flow passes to the place called "pressure zone of the system". The force required to displace the sensor piston upwards is negligible: it only needs to overcome the contrary force exercised by the "drive piston" (21) which forces the sensor piston downwards, which will be analyzed below.

Drive Device: This component is comprised of a "drive piston" (21) which is displaced along the "drive cylinder" (22) and is hermetically adjusted to said cylinder by means of the "drive V-seal" (23). This seal prevents the pressure of the system from entering the cylinder and, on the contrary, permits the displacement of the pressure from the cylinder to the system when it goes down in the second one. The drive piston is joined longitudinally with the sensor piston by the "sensor shaft" (17). When the pump flow pressure forces the sensor piston upwards, the upper limit is the "upper stop" (24). The section of the drive piston less the section of the sensor shaft, is added to the section of the sensor piston, and therefore, the pressure of the system exercises greater force on the upper part than on the lower part of the sensor piston, that is, the drive piston forces the sensor piston downwards against the pump drive. When the flow demanded by consumption decreases to the volume of flow equivalent to that of a partially open consumption (Qg), the sensor piston is located in the bearing cylinder, the lower limit imposed by the "lower stop" (25): with Qg, the force of the drive piston overcomes the impulsion force of the motorpump. This limit coincides with the point where the pressure of the system activates the pressure switch to stop the motorpump. This mechanism will be analyzed below.

Pressure Transfer Device: This component comprises the "transfer chamber" (31), the "piston collar" (32), the "piston cone" (33), the "transfer V-seal" (34) and the "pressure switch connection conduit" (35). When the sensor piston reaches its lower position, the piston collar, which is a segment with less diameter than the sensor shaft (17), appears outside the transfer V-seal and the pressure of the system comes in through this separation towards the transfer chamber. The pressure is immediately communicated through the connection conduit to the pressure switch. On the other hand, the internal pressure of the transfer chamber can never exceed the pressure of the system, since any higher difference will be transferred towards the system through the transfer and drive V-seals. However, these seals will retain the higher pressure of the system outside the transfer chamber until, as explained, the piston collar has surpassed the transfer V-seal. When the pump is activated and displaces the sensor piston, the sensor shaft enters the transfer V-seal, expanding it softly by means of the piston cone until it is perfectly adjusted.

Pressure switch (not shown): Since this set is so widely known, the analysis and operation of its parts will not be studied. In its relation to the operation of the Sensaflow, the pressure switch will reach its cut-out pressure only when the pressure of the system enters the transfer chamber and, as discussed, this only happens when the sensor piston reaches its lower point. This function is most important since the pressure regulating cut-in pressure of the pressure switch is not relevant, provided it is lower than the pump pressure when it drives a volume of flow as small as Qg. Cut-in pressure of the pressure switch is reached when the pressure of the system reaches such level, since the pressure of the transfer chamber changes similarly to the pressure decrease of the system. The decrease in pressure in the system may be slow or fast. It is slow when a small leakage or drip exists in the consumption. In this case, and as long as such consumption persists, cut-in pressure will be gradually reached. Decrease in pressure of the system may be speedy if a faucet is opened in the consumption. Speed in the reply, which consists in the starting of the motorpump, is important for two reasons: the connection pressure may be maintained as low as possible (only above the highest consumption) achieving greater pressurized water accumulation capacity or regulation volume; and the consumption caused by undesired drips and/or leaks tends to disappear since it is subject to increasingly lower pressures.

Hydropneumatic Tank (50): This is a single component consisting in a watertight tank only connected to the upper part of the body (14). It contains a volume of pressurized water called "regulation volume", in the space produced by the compression of the air located between the connection pressure of the pressure switch and the cutoff pressure of the motorpump. It must be noted that this pressure exceeds the cutoff pressure of the pressure switch and corresponds to the pressure developed by the motorpump when it is driving Qg which, as defined, is the volume of flow equivalent to a partially open faucet. Only at this point, the pressure of the system is transmitted to the pressure switch which cuts off the pump.

Air-Pump Activator: This component comprises the "actuator piston" (61) which is longitudinally displaced by the "actuator cylinder" (62) which is hermetically adjusted in the actuator piston by means of the "actuator ring-seal" (63). The upper limit of this displacement is imposed by the "upper stop of the actuator cylinder" (64). The lower displacement limit is located in the "intake port" (74) which will be discussed below. The actuator piston is moved from the hydropneumatic tank by the force of the higher pressure of the liquid inside the tank, when the pump is turned off and a consumption exists which decreases the pressure of the system generating a difference. On the contrary, when the pump starts operating, the pressure in the system increases over that of the hydropneumatic tank and the difference in pressure forces the actuator piston to displace itself towards the hydropneumatic tank until reaching the upper stop of the actuator cylinder. The large relative area of the actuator piston makes it most sensible to the differences in pressure which are produced and permits the actuator to absorb great forces.

Air-Injection Pump: The objective of this component is to replace air lost by dissolution in the pressurized water within the hydropneumatic tank. It comprises an "injector piston" (71) which travels inside the "injector cylinder" (72). The "injector V-seal" (73) adjusts the injector piston to the injector cylinder, preventing transmission of the pressure of the system inside the injector cylinder, but permitting the passage of compressed air upwards when the air pressure exceeds the system pressure. Injected air goes up towards the hydropneumatic tank due to its lower density. The actuator piston and the injector piston are joined by their shafts and the force of the first one activates the second. In its displacement downwards towards the lower stop imposed by the "intake port" (74) it compresses air which gradually enters the system as it acquires the same pressure. The importance that the lower displacement stop be the same intake port, is due to the fact that in this way no free air-containing volume remains, and air may be compressed at gerater pressures than the highest pressure reached by the system.

In its upwards displacement, the vacuum produced within the injector cylinder is filled in by external air which enters through the intake port. Air arrives at this point through a valve consisting in a "valve membrane" (75) which has a "passage port" (76). Normally the valve memberane obstructs the "closing cone" (77), intake port of external air, due to the drive exercised by the actuator piston when it goes down, helped by the "valve spring" (78). Only when a vacuum is produced due to the upwards displacement of the injector piston, the force of the valve spring and membrane is overcome; separated from the closing cone by the difference in pressure, it admits the entry of air from outside the system through the "intake conduit" (79), which is a tunnel that communicates the valve with the outside.

Transfer Device: The purpose of this component is to permit the entry of water to the hydropneumatic tank with no passage limitation and enable the limitation of its outflow pursuant to a determined volume of flow. For the entry of water to the hydropneumatic tank it has "intake ports" (81). In turn, for the outflow of water from the hydropneumatic tank it has a "flow regulator" (82) which is inserted within an "outlet conduit" (83) that discharges in the "outlet ports" (84). These last two components are part of the actuator piston. The intake ports are open only when the actuator piston reaches the upper limit of the actuator cylinder. This only happens when the pump is operating and demand for consumption does not increase in that phase: the higher pressure produced by the pump forces the actuator piston towards the upper stop of the actuator cylinder and water enters the hydropneumatic tank. Should consumption increase, the system pressure goes down and the actuator piston is displaced obstructing the outlet ports. This also happens when the pump is not operating: as soon as it stops, even though no consumption exists, the actuator piston goes down due to the vacuum that exists in the injector cylinder; the actuator piston obviously moves downwards when consumption exists, which generates differences in pressure between the hydropneumatic tank and the system. The reason that the intake ports open only when the actuator piston reaches its maximum level, is precisely to force the actuator piston to achieve such level in order that the injector pump may suction the greatest possible amount of air. The outlet of water from the hydropneumatic tank takes place by means of a system that forces the actuator piston to go down to its minimum level to compress air within the injector pump. The outgoing volume of flow must be higher than Qg to prevent the pressure of the system, with a consumption of approximately Qg, from decreasing to cut-in pressure and producing a very high frequency between startings of the pump due to the impossibility of the regulation volume to supply this type of consumption. On the other hand, if the outgoing volume of flow is regulated through the flow regulator for a lower consumption than that required by a totally open consumption, this second consumption is immediately supplied by the starting of the pump. In fact, the pressure of the system immediately goes down to cut-in pressure due to the impossibility of the hydropneumatic tank to supply it through the flow regulator which is only sized to permit the passage of a smaller volume of flow, and the pump is immediately activated to supply this sudden increase in consumption. The reaction of the pump is so fast that the pressure decrease is practically not perceived in the consumption. Also, the pressure in this case is the one permitted by the pump and not the pressure that would be reached if cut-out pressure were regulated too low. Since a sudden increase in consumption may be supplied by activating the motorpump and distending the connection pressure, its regulation may be as low as permitted by the difference in elevation between the pressure switch and the consumption with lower geodesical height. A low connection pressure has the following important advantages: 1) it virtually eliminates loss due to drips and leakages as such losses are subject to low pressure; and 2) it takes better advantage of the volume of the hydropneumatic tank due to increase in the regulation volume caused by higher pressure differentials between the connection and cutoff pressures. The flow regulator may also be regulated for greater volumes of flow. In this way, if consumption occurs, the pump will be driven only when the pressure of the system, including the pressure of the hydropneumatic tank, is reduced to the connection pressure.

Figure 2A:
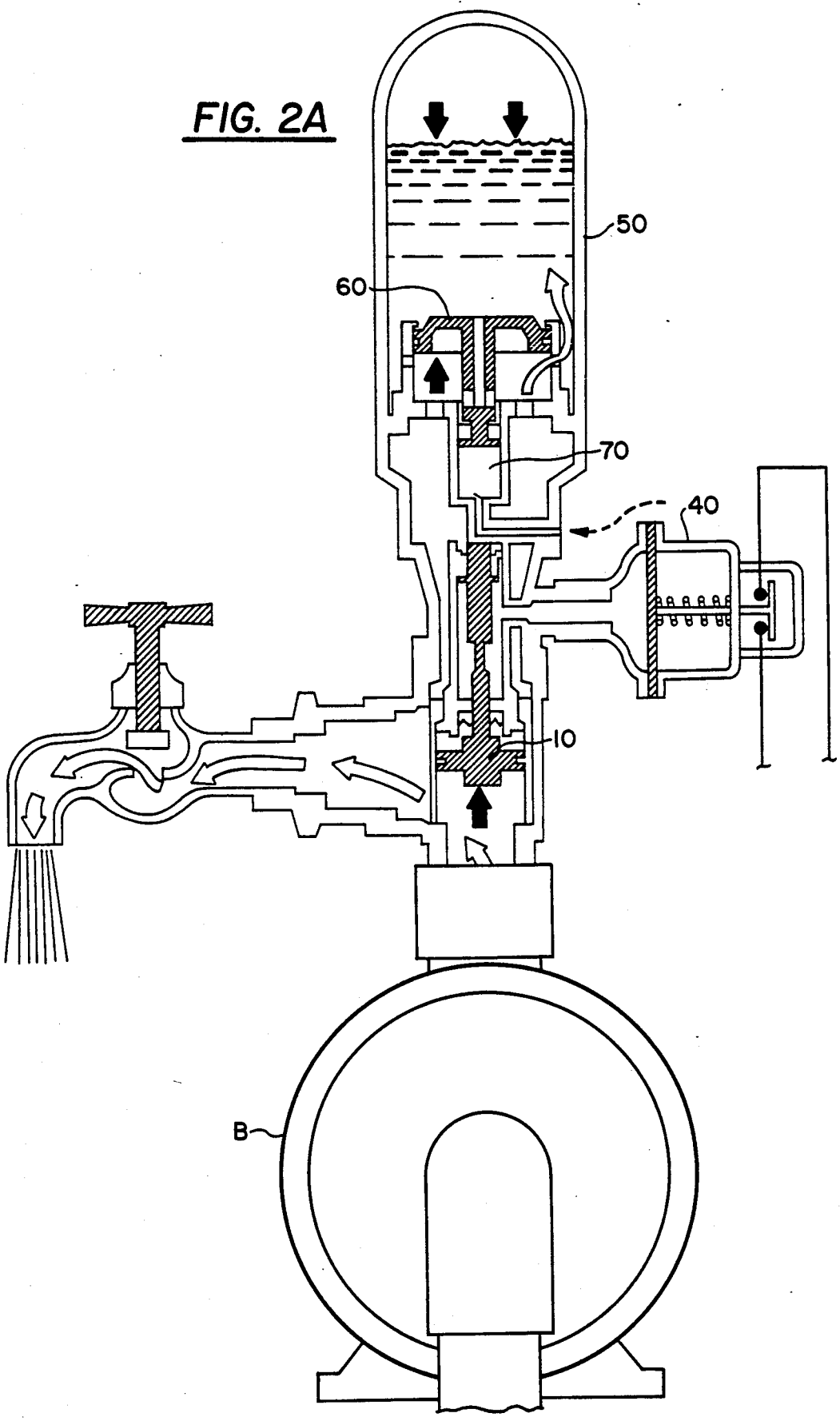
FIGS. 2A-2C are diagrammatic views of the hydropneumatic device shown in operation in various stages of consumption.

After separately analyzing the operation of the various functional components, the interdependent operation of these components must be analyzed. To this effect, the operation will be analyzed in relation to the type of consumption. Thus, it may be indicated that three possible consumption conditions may exist:

1. Greater or equivalent consumption to that of an open faucet (see FIG. 2A). In this case, the pump B will operate continuously, the flow sensor (10) will be in an open position and the pressure switch (40) will keep a pressure below cut-out pressure, even if the pressure of the system increases. As seen above, the pressure of the system will only be communicated to the pressure switch when the flow sensor is inserted in the bearing cylinder (20), which condition only occurs when consumption goes down to Qg or less. On the other hand, the actuator piston (60) will remain at its upper limit and the hydropneumatic tank (50) will consume part of the volume of flow delivered by the pump when replacing its regulating volume in case the pressure of the system increases gradually due to a reduction in consumption. Finally, the air-injection pump (70) has already suctioned air from outside.

Figure 2B:
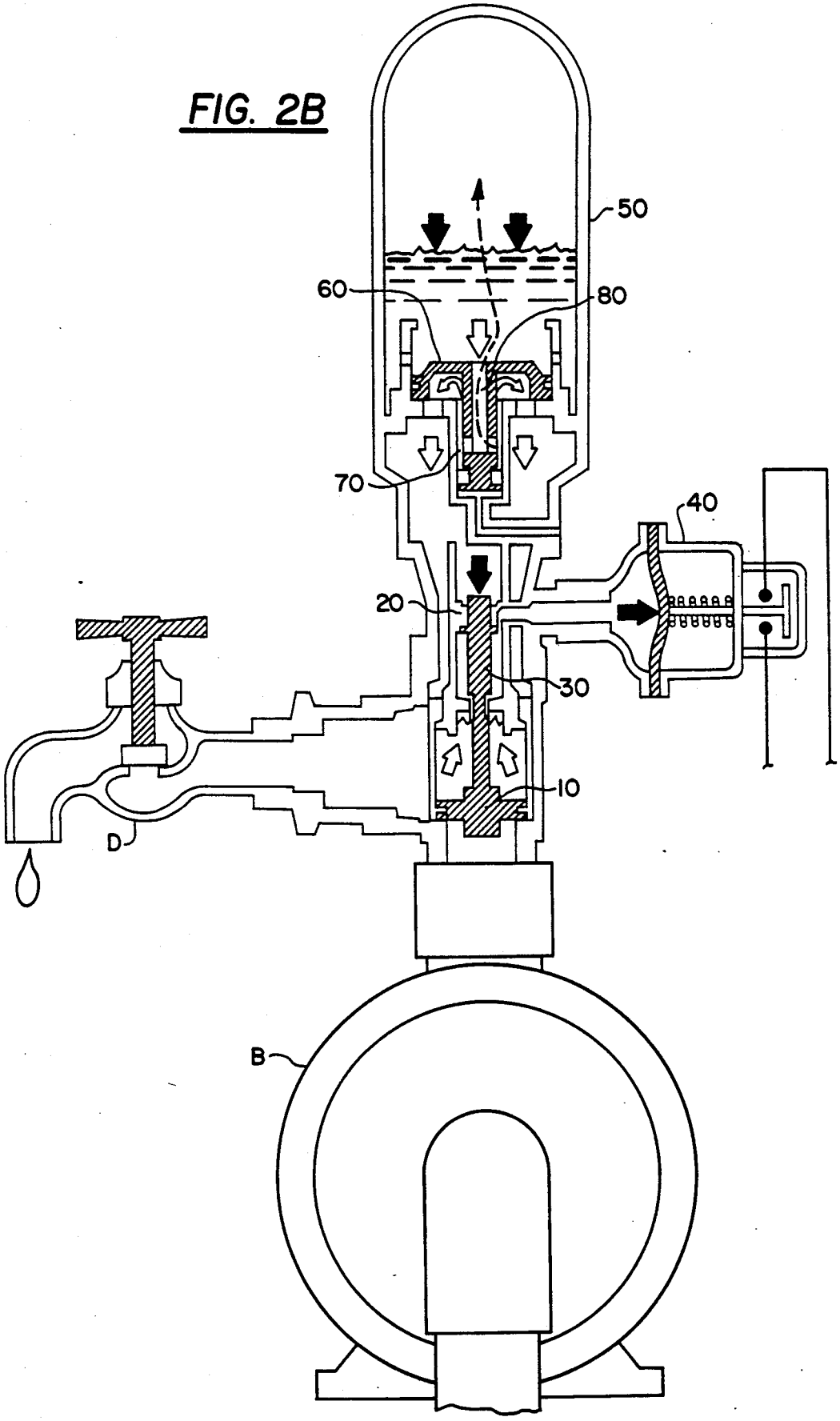

2. Consumption lower or equivalent to a partially open consumption (see FIG. 2B). This consumption is usually produced by leakages or drips in the distribution system when a faucet has remained partially open. If the pump has been operating when such consumption is reached, the sensor piston (10) is inserted in the bearing cylinder due to the lower volume of flow required, and the pressure of the system is transmitted to the pressure switch (40) through the transfer system (20). Since the pressure has exceeded the cut-out pressure of the pressure switch, the pump stops. From that time, consumption is supplied through the flow regulator (80) with the regulation volume stored in the hydropneumatic tank. The actuator piston (60) goes down to its lower limit over the intake port of the air-injection pump (70) and the air within this pump is compressed until it reaches the pressure of the system, leaving the system upwards until subsequently reaching the hydropneumatic tank (50). Consumption continues to be supplied by the regulation volume until the pressure of the system goes down to cut-in pressure. It is possible that drips and leakages will absolutely stop when the pressure of the system reaches such a low level that it may be exceeded by, for example, the expansion force of the elastic seals of a faucet, which have been leaking at a higher pressure. If drips and leakages disappear before arriving at cut-in pressure, the pump does not start if an additional consumption is not sensed. On the contrary, when cut-in pressure is reached, the pump operates until replacing the regulation volume which has been used up, and stops when the pressure of the system increases to the one required to drive Qg. At this point, the pump remains shut down until the next cycle or until a greater consumption occurs. Whenever the pressure of the system reaches cut-in pressure, the pressure switch connects and activates the motorpump. The sensor piston is separated from the bearing cylinder and the sensor shaft (30) obstructs the transfer V-seal, preventing the pressure to be transmitted to the pressure switch until the sensor piston is inserted once again in the bearing cylinder. The actuator piston goes up to its maximum point permitting the free entry of the flow to the hydropneumatic tank, only limited by its capacity. Vacuum is formed within the cylinder of the air-injection pump, which is filled in with outside air. The cycle is completed when the pump stops.

Figure 2C:
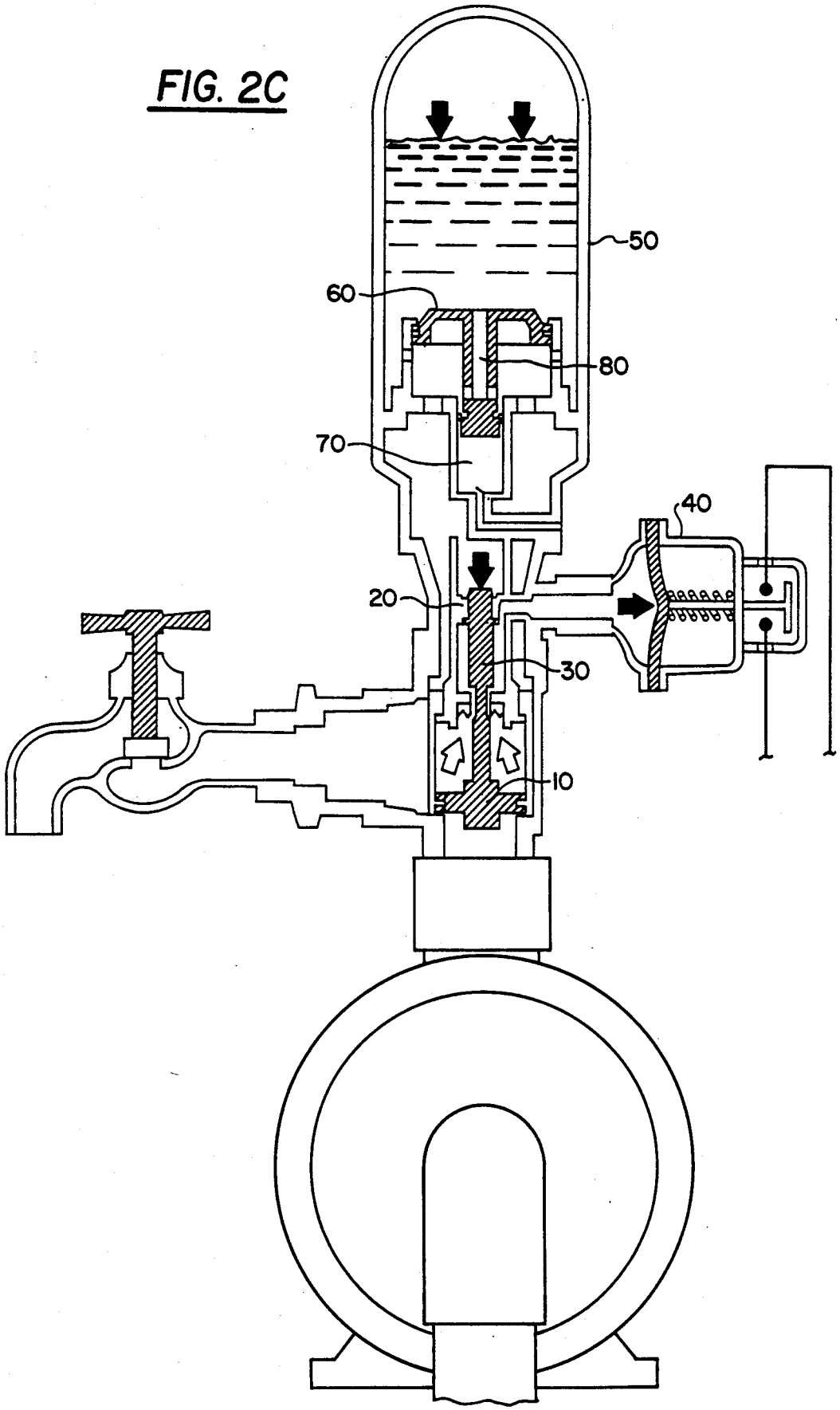

3. No consumption (see FIG. 2c). Pump B has already stopped and cannot operate again, the pressure of the system is maintained and no consumption of the regulation volume exists.

The first thing that must be pointed out in the interaction of the just analyzed components is that "Sensaflow" is distinguished from the hydropneumatic system, including the hydrosphere system, since in the first system, the pump starts and stops successively when consumption fluctuates between zero volume of flow and Qg. With consumption exceeding Qg, the pump continues operating. In the second system, this phenomenon occurs when consumption is between a volume of flow over zero and Qg, that is, the volume of flow of the pump at cut-out pressure. With consumptions exceeding Qg, the pump continues operating. In both cases, the pump remains inactive with zero consumption.

In the second place, the functioning of the flow regulator must be pointed out. It enables the passage from the hydropneumatic tank to consumption, of a lower volume of flow than the one equivalent to a completely open consumption. Thus, the pump is instantaneously activated when any consumption is higher than that permitted by the flow regulator. In this way, the cut-in pressure of the pressure switch may be regulated as low as the consumption pressure at the highest elevation. This type of regulation permits a decrease in consumption caused by possible and undesired losses due to drips and/or leakages.

The two indicated factors have incidence in the reduction in the size of the hydropneumatic tank and the consequent reduction in cost.

In the third place, the air-injection system is most beneficial, since it eliminates air leakages and keeps the air pressure at the cut-in pressure of the system.

Finally, the miniature size of the Sensaflow system permits its manufacture with low cost and corrosion and rust-resisting materials such as, for example, plastics.

I claim:

1. A constant pressure hydropneumatic arrangement for automatically controlling the starting and stopping an electrical pump that supplies the demand for a fluid with various consumption, said hydropneumatic arrangement comprising:

a flow sensor device for detecting variation in demand for consumption including a sensor piston disposed facing an outlet of the pump;

a driving cylinder cooperating with said sensor piston, said driving piston communicating with fluid pressure;

a pressure transfer chamber, said driving cylinder disposed within said pressure transfer chamber, said pressure transfer chamber communicating to the fluid pressure by means of said driving piston and communicating from the fluid pressure only when said driving piston is at a point of maximum displacement;

a pressure control switch being coupled to said pressure transfer chamber and being electrically connected to the pump; and a hydropneumatic tank including:

an air-injection pump having an actuating piston being coupled to said hydropneumatic tank and connected to outside air;

a fluid flow regulator for regulating the flow of fluid from said hydropneumatic tank; and a fluid transfer device for transferring fluid towards said hydropneumatic tank.

2. A hydropneumatic arrangement for actuating a pump upon pressure decrease and for deactivating the pump upon flow decrease, said hydropneumatic arrangement comprising:

a bearing cylinder;

a flow sensor piston movably disposed within said bearing cylinder, said flow sensing piston substantially closing an outlet of the pump when said flow sensing piston is in a maximum displacement position;

a driving piston connected to said flow piston by a common shaft, said driving piston having a greater sectional area than said shaft, said flow sensor piston being moved according to a variation in consumption demand by an interaction of a force of flow exerted against said flow sensor piston and a force of pressure exerted on said driving piston, said driving piston being movably disposed within a drive cylinder;

a pressure switch being electrically connected to an electric motor that drives the pump, said drive cylinder communicating with said pressure switch, said drive cylinder being opened to system pressure in said driving piston, communicated toward the system pressure due to a sealing arrangement that permits a flow outwardly of, but not inwardly into, said drive cylinder and communicated from the system pressure only when said flow sensor piston is at a point of maximum displacement, through a narrow portion in said common shaft which coincides with a seal of said drive cylinder leaving an open passageway at said narrow portion;

a hydropneumatic tank having an air injection pump, said air injection pump including a pump cylinder having an end thereof connected to outside air so that air flow is permitted to enter but not permitted to leave when the pump cylinder is displaced inwardly, an injector pump piston cooperating with said pump cylinder so that air flow may be displaced towards the system pressure when said injector pump piston is displaced so as to compress the air to a pressure greater than the system pressure, said compressed air flowing into said hydropneumatic tank without flowing back into said pump cylinder; and an actuating piston for driving said injector pump piston, said actuating piston having a greater sectional area than said injector pump piston, said actuating piston being displaced toward said hydropneumatic tank when the system pressure is greater than pressure in the tank.

3. A hydropneumatic arrangement according to claim 2, wherein said flow sensor piston is provided with a groove, a sensor ring being fitted in said groove; said sensor ring being radially cut in a contour point thereof so as to define an opening for a passage of a volume of flow equivalent to that of a partially open consumption.

4. A hydropneumatic arrangement according to claim 2, wherein the driving piston is provided with a drive V-seal.

5. A hydropneumatic arrangement according to claim 2, wherein said driving piston is located at an inlet of the hydropneumatic tank, said driving piston extended by an actuator cylinder, said actuator cylinder including an actuator ring-seal.

6. A hydropneumatic arrangement according to claim 2, wherein said hydropneumatic tank further includes an inlet conduit.

7. A hydropneumatic arrangement according to claim 2, wherein said hydropneumatic tank further includes a water outlet regulator.

8. A hydropneumatic arrangement according to claim 2, wherein said flow sensor piston includes a sensor shaft having a piston collar at an end thereof, said piston collar having a smaller diameter than an internal diameter of a transfer V-seal.

9. A hydropneumatic arrangement according to claim 8, wherein the diameter of said sensor shaft and the diameter of said piston collar are connected by a sensor cone having a conical area.

10. A hydropneumatic arrangement according to claim 2, wherein said injector pump piston is movable within said injector cylinder, and including an injector V-seal.

11. A hydropneumatic arrangement according to claim 10, wherein said injector cylinder includes an air-admission valve at an end thereof.

* * * * *